US007225899B2

(12) United States Patent
Molnar et al.

(10) Patent No.: US 7,225,899 B2
(45) Date of Patent: Jun. 5, 2007

(54) STAIR LIFT DEVICE

(75) Inventors: Gordon Molnar, Toronto (CA); Peter Shaw, Richmond Hill (CA)

(73) Assignee: Rutherford Independence Limited, Concord, Ontario (CA)

( * ) Notice: Subject to any disclaimer, the term of this patent is extended or adjusted under 35 U.S.C. 154(b) by 141 days.

(21) Appl. No.: 10/822,554

(22) Filed: Apr. 12, 2004

(65) Prior Publication Data

US 2005/0224293 A1 Oct. 13, 2005

(51) Int. Cl.
*B66B 9/08* (2006.01)

(52) U.S. Cl. ..... 187/201; 187/202; 187/271; 187/277; 187/300; 318/17; 414/550; 248/425; 297/183.9; 297/463.1

(58) Field of Classification Search ..... 187/200, 187/216, 220, 276, 290, 302, 410; 104/300, 104/302

See application file for complete search history.

(56) References Cited

U.S. PATENT DOCUMENTS 2,507,887 A * 5/1950 Cheney ..... 187/201
2,888,099 A * 5/1959 Hoffmann ..... 187/202
3,830,379 A * 8/1974 Dechansreiter et al. ..... 414/274
4,043,427 A 8/1977 Ackerman ..... 187/201
4,913,264 A * 4/1990 Voves et al. ..... 187/201
5,230,405 A * 7/1993 Bartelt ..... 187/201
5,316,258 A * 5/1994 Gauger et al. ..... 248/548
5,533,594 A 7/1996 Tremblay et al. ..... 187/201
6,000,758 A * 12/1999 Schaffner et al. ..... 297/344.17

FOREIGN PATENT DOCUMENTS

EP 1 197 465 A1 4/2002
EP 1 035 064 B1 7/2004
EP 1 125 882 B1 11/2004

* cited by examiner

*Primary Examiner*—Gene O. Crawford
*Assistant Examiner*—Stefan Kruer
(74) *Attorney, Agent, or Firm*—Vidas, Arrett, Steinkrau

(57) ABSTRACT

A stair lift for lifting and lowering at least one person on a rail on a stairway. There is a carriage mountable to the rail, the carriage having a track engaging drive, and a motor to power the drive, the powered drive causing the carriage to move along the rail. There is a central support post mounted on the carriage and an offset arm connected to the seat support post. The offset arm is mounted to the carriage in one of a left side or a right side position. A seat is mounted on the offset arm, and a notched plate secures the seat in position on the offset arm in either the left side or right side position and permits the seat to swivel between a sideways facing position and an upward facing position to facilitate the person getting into and out of the seat.

42 Claims, 12 Drawing Sheets

STAIR LIFT DEVICE

FIELD OF THE INVENTION

This invention relates generally to the field of motorized devices of the sort that are used to move goods or people short distances over obstacles. Most particularly this invention relates to devices of the sort that may be used to lift and lower mobility challenged people on stairs.

BACKGROUND OF THE INVENTION

Currently many developed western economies have aging populations. Improved health care and advanced medical technologies are contributing to longer lives on average. As time passes, more and more people reach an advanced age. With advanced age comes reduced mobility, for example, less ability to get up and down stairs in a family home. A modern trend in managed health care is home care, in which individuals are encouraged to live at home rather than in an institution. Home care generally includes a higher quality of life and can be less expensive. Therefore, there is a growing need for devices to enhance the mobility of seniors and other mobility challenged individuals who wish to remain in their homes, but have difficulty using stairs or the like.

To meet the needs of such persons, motorized devices to lift and lower a person up or down stairways have become more popular. In some configurations, the person sits on a seat which rides on a rail. A motor is used to drive the device up and down the rail. The rail is typically made from metal and the drive mechanism is usually a toothed wheel which engages a rack located in the rail. The motor drives the toothed wheel which then rotates and advances the seat along the rail. In some cases the seat is replaced with a platform, onto which a wheelchair may be driven. Thus, rather than sitting on the seat, the person remains in their wheelchair as the platform is lifted or lowered and then the wheelchair simply rolls off the platform at the end of the journey.

These types of devices have met with significant success, but suffer from a number of drawbacks. As can be appreciated, these devices, among other things tend to permit a mobility challenged person to remain in their own home, even though they may no longer be able to climb the stairs between the upstairs and the downstairs. Thus, there is a class of such devices that are specifically designed to be retrofitted into existing structures by being placed, for example on an existing stairway. The racks and rails are typically made from metal, to provide sufficient strength for the rack and pinion style gear drive. Such metal components are heavy and somewhat expensive. Thus, it can be both costly and awkward to ship the material to where it is needed. Its weight also makes it awkward and difficult to install. Further, the drive gear, which is typically part of the moving platform is also heavy and expensive. Weight in the drive gear provides a double liability, because not only is the device more expensive to make and ship, every time the lift device is used more energy is required to lift the heavy gear and motor up and down the rail.

Another problem in the prior art devices is that the motors are typically fairly large. This is due to the need to provide enough power to overcome inefficiencies in the drive system as well as enough lift to first, lift the person with a reasonable margin of safety, then, lift the weight of the platform and/or seat, as well as the heavy elements of the drive train including both the motor and the drive gear. In this sense there is a negatively reinforcing cycle in which a heavier drive train requires a heavier motor, which in turn requires more lifting power and again a heavier motor. As a result the prior art devices tend to include expensive and heavy components in the drive train, including the motor itself.

Another problem in prior art devices is that the stair lift devices are relatively difficult to install. In most cases professional installers are required. Often, due to the heavy nature of the elements two installers are required. Typically they will have to check out the installation site, determine whether the rail is to be installed on the left hand or right-hand side of the stairway and then proceed with the installation. In many cases customised left hand or right-hand parts are required. In other cases the carriage and chair must be partially disassembled and then reassembled to permit the chair to face the right way when installed. This requires time, tools and expertise. Also, due to the need for the chair to be clear of the wall or rail, the stairway becomes substantially blocked by the installation of the device.

SUMMARY OF THE INVENTION

What is desired is an improved stair lift assembly which is lightweight and easy to install. The chair should be free to pass up and down without interference of the wall or stair hand rail, but the rail should be as close as possible to the side to leave as much remaining stair tread as possible, so that others may freely use the stair. Preferably the motor will be lightweight, efficient and easy to lift into place on the rail. Preferably the chair may be readily positioned in a left hand or right-hand configuration without the need for tools or special expertise in installation. Most preferably the stair lift will be simple enough to install to permit a home owner to install it as a DIY (Do It Yourself). To ensure that the installation is easy, various elements are preferably configured to be assembled in only one (i.e., the correct) way.

Therefore according to a first aspect of the present invention there is provided a stair lift for lifting and lowering at least one person on a rail on a stairway, the stair lift comprising:

- a carriage mountable to said rail, said carriage having a track engaging drive, and a motor to power said drive, said powered drive causing said carriage to move along said rail;
- a central support post mounted on said carriage;
- an offset arm connected to said seat support post, said offset arm being mountable to said carriage in one of a left side or a right side position;
- a seat mounted on said offset arm, and
- a means for angularly securing said seat in position on said offset arm in either said left side or right side position and for selectively releasing said seat to permit said seat to swivel between an upward facing position and a sideways facing position on said offset arm to facilitate said person getting into and out of said seat.

BRIEF DESCRIPTION OF THE DRAWINGS

Reference will now be made, by way of example only and without limiting the broad scope of the invention as defined in the appended claims, to drawings which depict preferred embodiments of the present invention and in which:

DETAILED DESCRIPTION OF THE PREFERRED EMBODIMENTS

Figure 1:
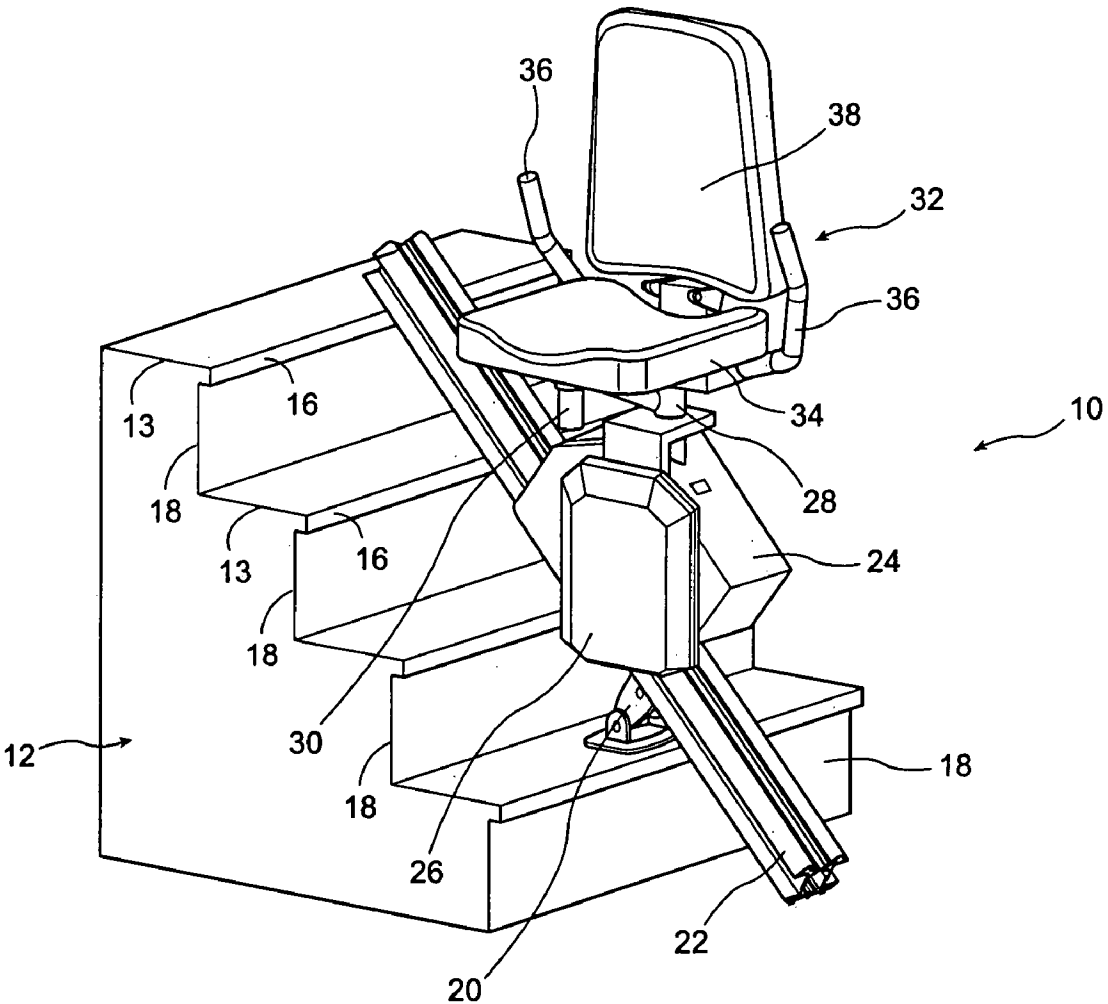
FIG. 1 is a view of a stair lift on a stair according to the present invention.

FIG. 1 shows a stair lift 10 according to the present invention. The stair lift is shown mounted on a stair way 12 having stair treads 13 with noses 16 and risers 18. The stair lift 10 according to the present invention includes a number of components such as mounting brackets 20 to support a rail 22, a carriage 24 which travels along the rail 22, a foot rest 26, a central support post 28, an offset arm 30, and a seat 32. The seat 32 includes a seat portion 34, arm rests 36 and a back rest 38. Each of these components will now be described in more detail below.

Figure 2:
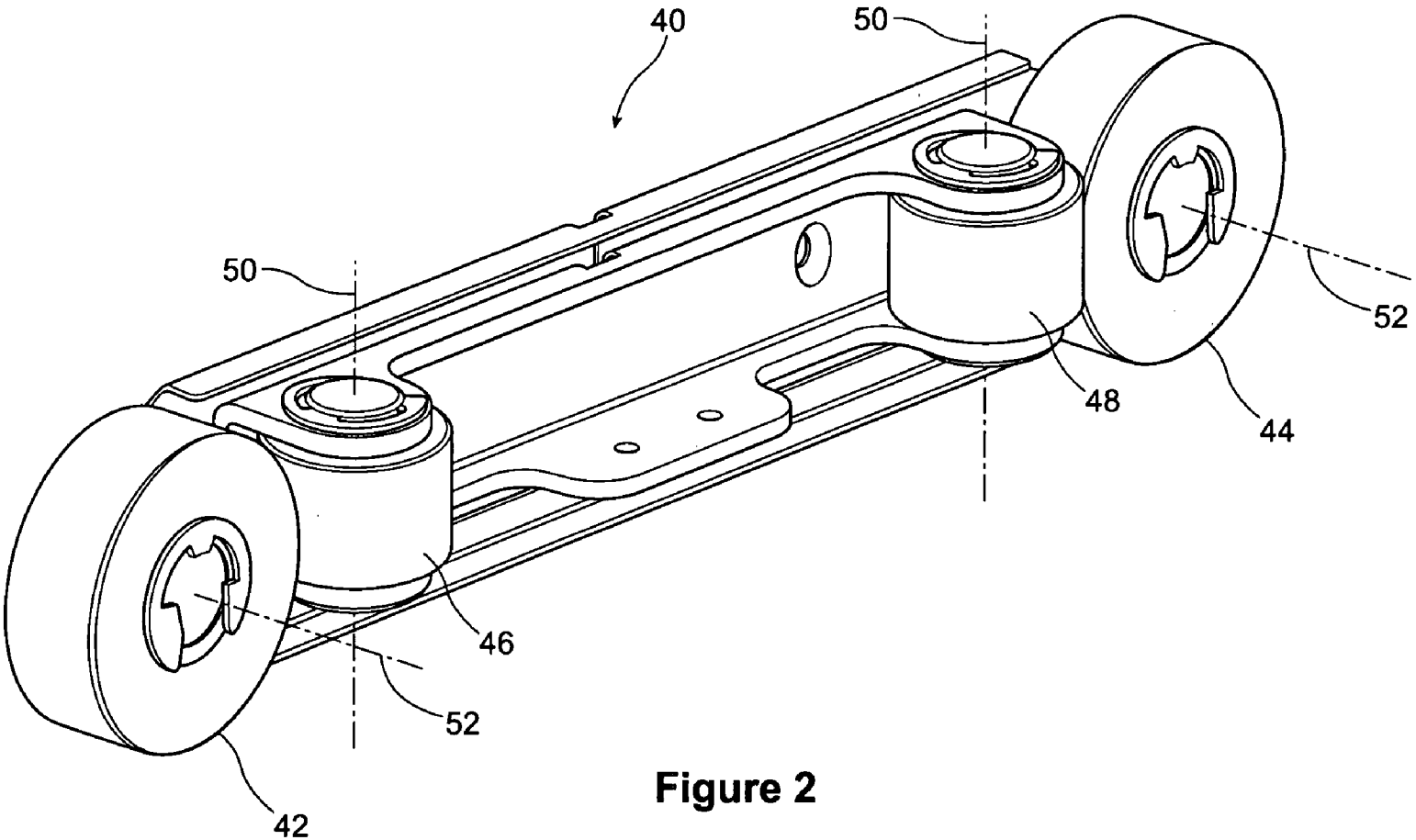
FIG. 2 is a close up view of a wheel set according to the present invention.
Figure 3:
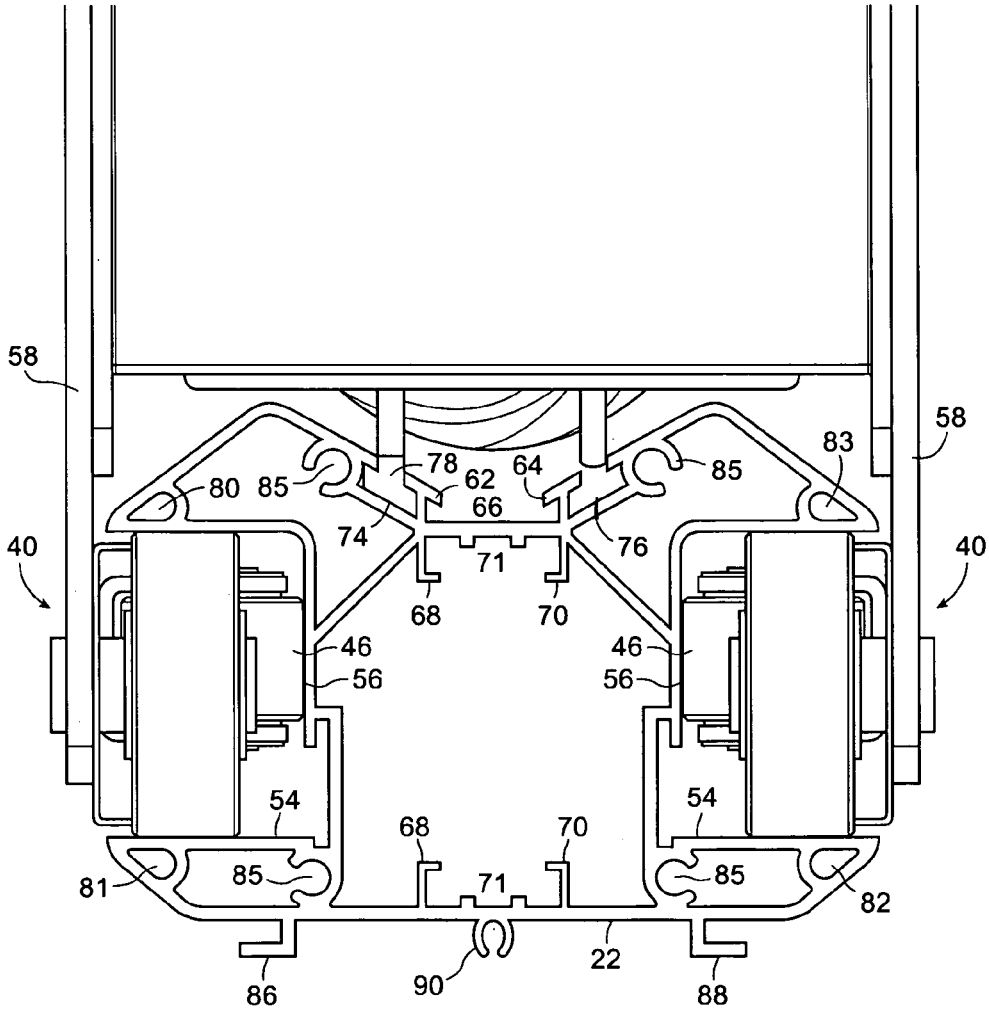
FIG. 3 is a cross sectional view of the two wheel sets, one of which is depicted in FIG. 2, engaging a rail according to the present invention.

The carriage 24 rides up and down the rail 22 by means of wheels guided by the rail 22. In FIG. 2 a preferred form of wheel bogey 40 is shown by means of which the carriage 24 easily rolls up and down the rail 22. In the preferred embodiment, two such wheel bogeys 40 are provided, one on either side of the rail. As can be seen in FIG. 2, each wheel bogey 40 consists of a pair of load-bearing wheels 42, 44 between which are located a pair of roller bearings 46, 48 which are mounted on axis 50 which is perpendicular to the load bearing wheel axis 52. The roller bearings 46, 48 are for the purpose of ensuring that each bogey 40 is smoothly guided along a roller track 54 within the rail 22. Turning to FIG. 3, a cross-sectional view of the rail 22 is shown. The rail 22 includes a number of features which are explained in more detail below. However, in FIG. 3 the bearings 46, 48 are shown bearing against an inside rail wall 56, and the load-bearing wheels 42, 44 are shown in opposed roller tracks 54 on each side of the rail 22. In this manner, the carriage 24 is guided firmly and smoothly up and down the rail. The load-bearing wheels 42, 44 convey the weight of the carriage 24 along the rail 22 in a relatively frictionless manner, and the bearings 46, 48 ensure that the bogey is aligned within the track to prevent binding or the like.

Although various different types of wheels are comprehended by the present invention, good results have been obtained with plastic wheels made from low wear self lubricating material such as NYLATRON NSM. With this material the wheels may be affixed directly to the axle, without the need for wheel bearings.

As seen in FIG. 3, the side walls 58 of the carriage 24 extend down to cover the wheel bogeys 40. The side walls 58 of the carriage 24 therefore help protect against foreign objects becoming inserted under the wheel bogeys 40. Thus, the side walls 58 are a safety feature which prevents children's hands from getting caught and hurt.

Turning to the rail 22 itself, there are a number of features which improve the functioning of the present invention. Beginning at the top middle, there are overhanging shoulders 62, 64 which form an outer rectangular slot 66 running the length of the rail 22 used to hold track sections in place. On the inside, arms 68, 70 form an inner rectangular slot 71 to locate plate shaped rail fasteners 73. Slots 71 are located at both the top and bottom of the rail 22. Grooves 74 and 76 are formed in the outside surface of rail 22 to hold trip elements 78 as explained in more detail below. Four corner pin slots 80, 81, 82 and 83 are formed for housing pin connectors 84 for alignment and securement of adjacent track sections of rail 22. Also shown are a number of screw or fastener anchors holes 85. Mounting bracket arms 86, 88 are formed on the underside of rail 22 to permit easy mounting of the mounting bracket 20 to the rail 22. A wire raceway 90 is also formed on the underside of the rail 22 to provide a substantially closed channel to take wires from one end of the rail 22 to the other. Opposed wheel bogey or roller tracks 54 are also formed to permit the wheel bogeys 40 to ride up and down the rail in a secure manner. It will be understood that the wheels are free running within the tracks 54, and that the carriage is driven by a motor drive system as explained below.

Various reinforcing web sections within the rail are also provided to enhance the load-bearing capacity of the rail. Most preferably the rail is made from extruded aluminum which on the one hand is strong and yet on the other is light. This means that the rail is more easily shipped and can be manipulated into place at the installation site more easily. Most preferably according to the present invention the aluminum rail will be provided in sections of a predetermined length. The sections are joined together, at the installation site and the top end of the rail may be trimmed to any desired length. It will be appreciated by those skilled in the art that other materials, such as reinforced plastic, fiber glass composites and other metals may also be used for the rail 22 but the use of a hollow aluminum section provides a light weight strong rail which is easily cut to length.

Figure 4:
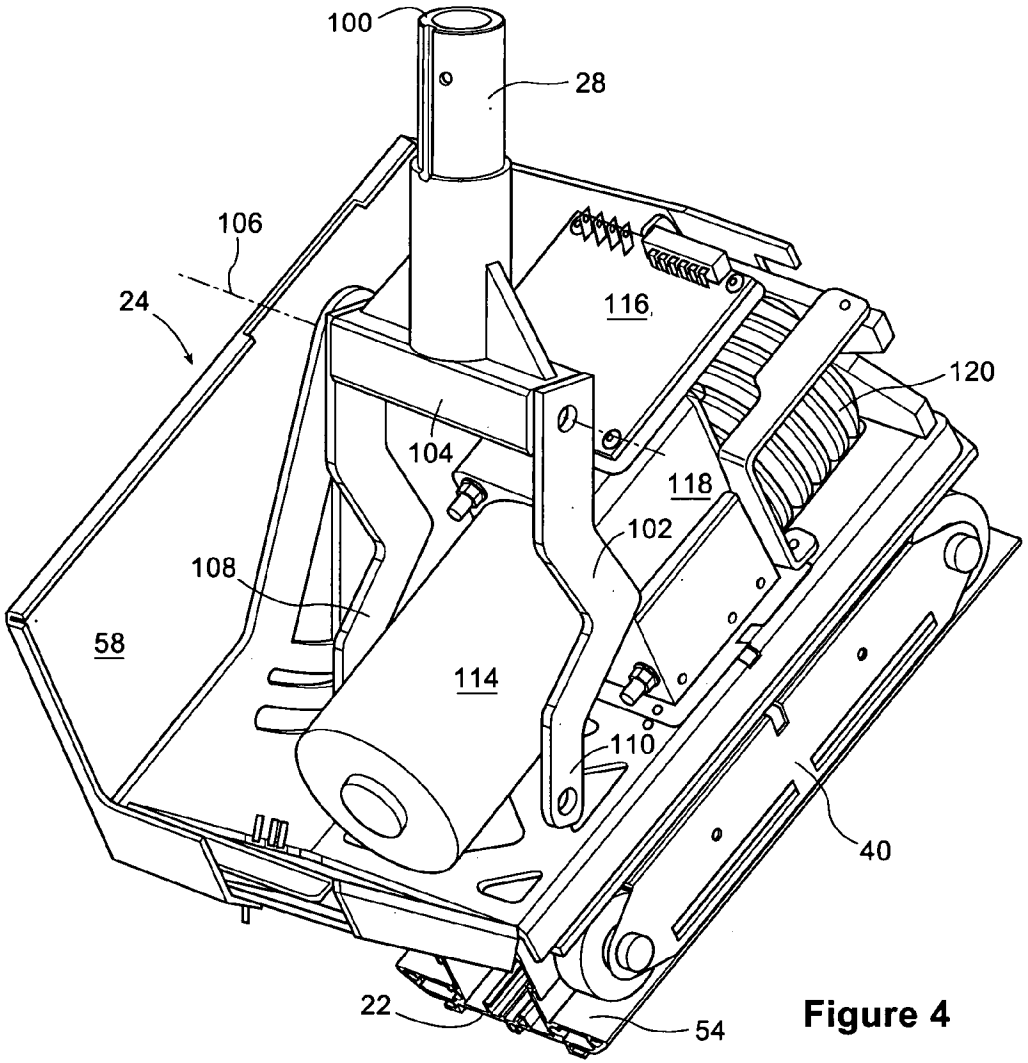
FIG. 4 is a view of the interior of the motor carriage of the present invention

Turning to FIG. 4, a view of the carriage 24 with some of the outer panels removed is shown. The central support post 28 is shown which includes a rod like top portion 100 and a forked lower portion 102. The forked lower portion 102 includes a cross member 104 which defines a pivot axis 106 as explained in more detail below. Each of the ends 108, 110 of the fork portion 102 is included with a fastener (not shown) to permit the central support post 28 to be adjusted and then locked into a vertical position notwithstanding the angle of the stair and the stair rail varying from installation to installation.

The forked lower portion 102 of the central support post 28 permits the center support post 28 to be positioned around the motor 114. A circuit board 116 is also shown together with a gear box 118 and a drive gear 120. Batteries 122 and 124 are also provided within the carriage 24, but are not shown. One of the aspects of the present invention is to have the stairway as free as possible from a blockage by the stair lift device 10, when the latter is not in use. This means that the carriage itself needs to be narrow in width. Also the present invention comprehends that left-hand side and right-hand side mounting can be accomplished with the same components. Thus, the carriage is most preferably symmetrical about its centerline. The present invention includes a centrally mounted motor 114 which connects to a centrally mounted drive gear 120 through a centrally mounted gear box 118. In this way a minimum overhang in both lateral directions is achieved. The central mounting of these components makes the carriage admirably thin, but in turn requires the forked lower end of the central support post as described above.

Considering the motor 114 and drive gear 120 in more detail, a number of different types of drive are comprehended by the present invention. However the most preferred drive system has three main elements, namely the motor 114, the drive gear 120 having spiral drive threads, and a track 210, incorporated into the rail 22. Each tooth is provided with a thrust surface which matches to surface of a drive thread of the drive gear. The drive of the present invention can both lift and lower the carriage along the rail by merely reversing the motor. Most preferably the drive gear is made from plastic and so are the teeth of the track. In this way low friction sliding contact can be made between the drive gear and the track to efficiently move the carriage along the rail. The plastic components are also light weight, reducing the overall shipping weight of the stair lift, and reducing the effort required to raise the carriage up the rail. Reduced effort means a less powerful motor can be used, reducing the weight of the motor and again reducing the effort required.

An aspect of the preferred drive system of the present invention is the distribution of load among a number of spiral threads and teeth to reduce the stresses on any individual tooth or spiral. The pressure, on any component in the drive train is a function of the load, divided by the area. Thus, to reduce the pressure on the individual components, such as the teeth and the drive threads, requires increasing the load-bearing area. The present invention provides design features which are used to increase the load-bearing area.

According to the present invention, one or more spiral threads can contact more than one tooth. Thus, if the spiral contacts two teeth, at the same time, as opposed to one tooth, the total load is the same, but the load carried by each tooth is reduced by one half. According to the present invention it is most preferable that the drive element is elongated so that at least one thread is sized and shaped to engage at least two teeth at the same time, to reduce the stress induced in each tooth. While the present invention comprehends that more than two teeth could be engaged by a single spiral drive thread this would require making the drive element considerably longer, or reducing the pitch of the drive thread. Making the drive element longer is undesirable as expensive and reducing the pitch is undesirable because this then slows the rate of progress of the drive train along the track for the same rotational speed.

To overcome the problem of reduced pitch that would be required to reduce loads by increasing thrust surface contact area, the present invention provides, in a most preferred configuration, multiple thread starts on the drive element. More specifically, the preferred form of the present invention will have one to twelve thread starts on the drive element, and most preferably about five. In this manner the load is equally distributed over five threads and further, most preferably at least one thread engages two teeth, for six thrust or bearing surfaces to be simultaneously engaged. In this manner rather than advancing along the track one tooth per revolution, as would be the case for a one thread drive element, the preferred device provides for an advance of five teeth per revolution, which provides a reasonable speed for the drive system of the present invention (having regard to the preferred tooth spacing).

As can be appreciated, the prior art device involving a cog or gear drive placed essentially all of the lift force to a single tooth at a time. These devices are typically required to be designed for a load of about 350 pounds, with a factor of safety. This requires a form of steel or other high strength metal teeth as well as a heavy metal cog or gear. In contrast, the present invention permits the load to be distributed over, for example six teeth, permitting a material having one sixth the strength to be used. Put another way, the track tooth of the present invention needs to be designed to withstand only a design load of 50 pounds, (500 pounds with a code required factor of safety of 10), not 350 pounds (3500 pounds with a safety factor of 10), as in the prior art.

Although the preferred drive system of the present invention uses a light weight battery-operated motor to drive a light weight spiral gear other efficient drive systems are also comprehended. All that is required is a drive system which can be centrally positioned and which includes enough power to lift and lower the carriage of the present invention.

A further aspect of the present invention is a recharge system for the batteries. Most preferably the recharge system includes charging contacts at either end of the rail. Sliding electrical contacts are provided on the carriage and are positioned so that the batteries will be charging when the carriage is located at either end of the rail. The contacts are powered from a wire placed in the raceway. The wire in turn is attached to a simple plug located in the rail. Thus, all that is required is to use the provided battery charger, which in turn uses a conventional electrical cord and plug for a wall socket, and a simple cable which plugs into the rail from a wall socket. Also, according to the present invention, the power contacts at either end of the rail are slid into slots on the side of the rail. The slots are differently sized, so that there is no possibility of inserting the wrong polarity contact in the wrong position. In this way the installation of the contacts is assured to be correct, even by an unskilled installer.

Figure 5:
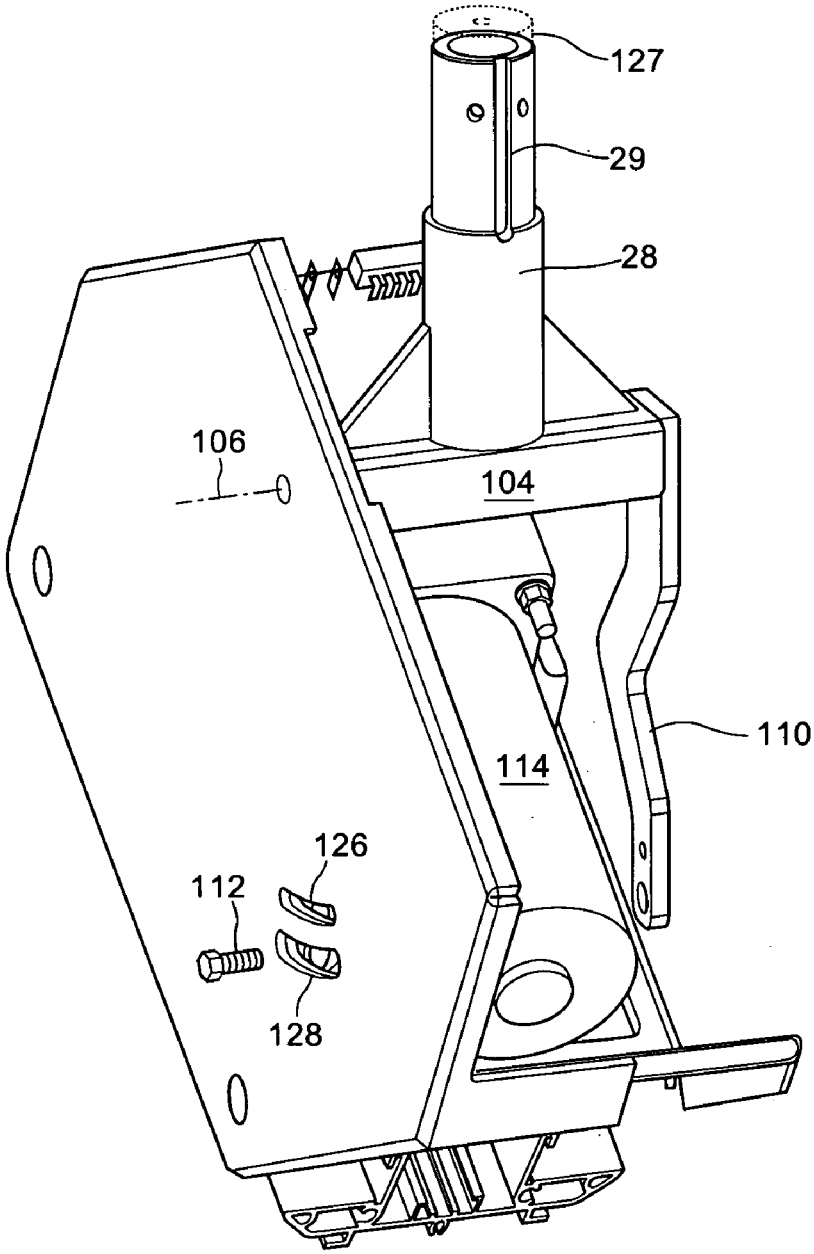
FIG. 5 is a view of the interior of the motor carriage of FIG. 4 from a different perspective.

Turning to FIG. 5, it can now be appreciated how the centre support post 28 may be pivoted and secured in position in the carriage 24. A keyway 29 is shown. The pivot axis 106 is shown together with slot 128 for the lock or fastener 112. A second slot 126 may also be used, but in the preferred embodiment is not. Most preferably the type of fastener used is a lock screw or the like which can be backed off with an appropriate tool to permit the centre post to be positioned in a vertical position. To assist in this the present invention comprehends including a small circular spirit level shown in dotted outline at 127 as part of the installation kit. Thereafter the fastener or locking screw can be tightened to lock the centre support post 28 in a vertical position.

Figure 6:
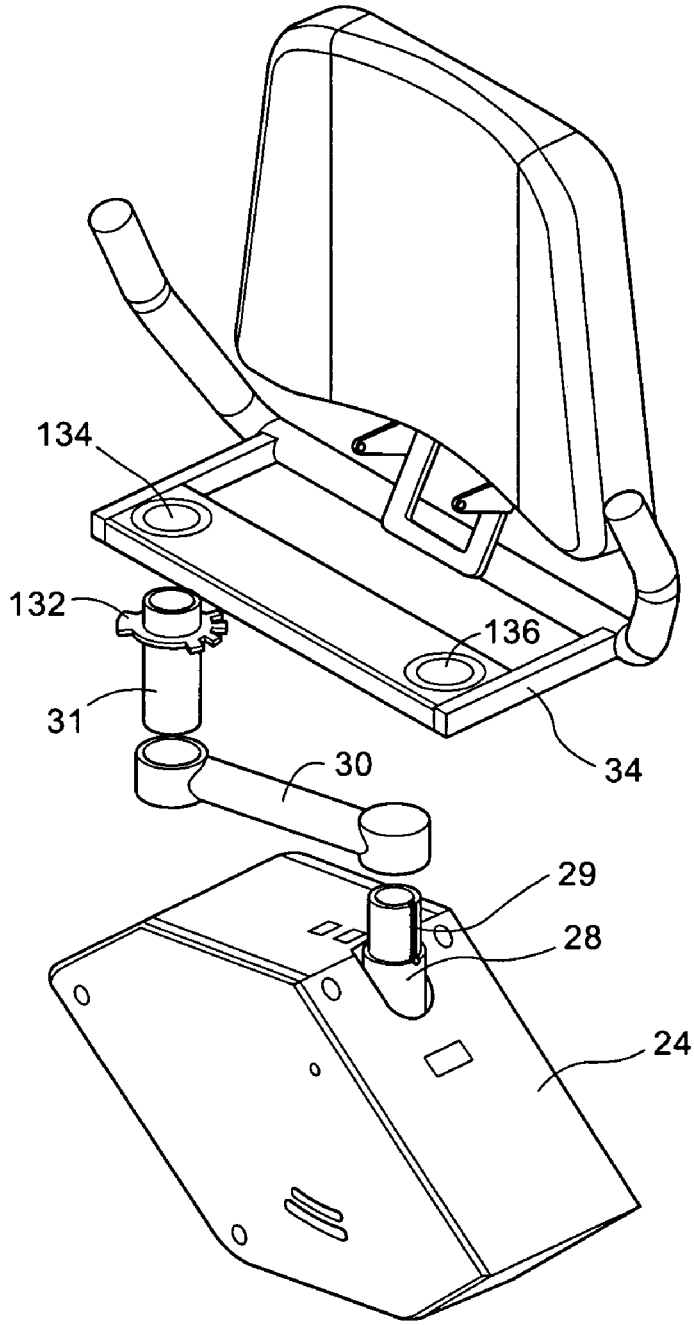
FIG. 6 is an exploded view of a seat carriage connection according to the present invention

Turning to FIG. 6, an exploded view of the seat support is shown. As shown, an offset arm 30 is connected to the centre post 38. A pivot post 31 is mounted in one end of the offset arm 30, and the seat 34 is mounted to pivot post 31. A means to selectively position the seat 34 is also provided which includes a notched plate 132. As shown, the seat portion of the seat includes left-hand and right-hand mounting points 134, 136 respectively.

The easy installation symmetry of the present invention can now be appreciated. The installer will decide upon a left-hand side or right-hand side installation. The offset arm includes a key which fits into keyway 29 and which permits it to be placed into the support post in an upstair direction and pointing inwardly about 30 degrees. Although the extent of the inward angle can vary thirty degrees has provided reasonable results. The keyway is set to permit the offset arm to extend inward from either a right hand or a left-hand side.

The next step is to position the pivot post in the support arm. The pivot post only fits into the offset arm in one way, which works for both right and left-hand installations. The only thing that changes, between a left hand and right-hand installation is which seat mount 134, 136 to use on the underside of the seat.

It can now be appreciated that the offset arm accomplishes two important functions in the present invention. First, it permits the seat, when mounted on the pivot post to pivot freely without contacting the wall. In fact, it is preferred to have the offset because the seat won't fit onto the pivot post if the offset arm is installed in the incorrect position. The second is that the offset arm projects the seat forward, so that in a dismounting or mounting situation at the top of a set of stairs, the seat projects past the top stair to reduce the chance of a person losing their balance and falling when getting into the seat. Another benefit of the angle between the line of travel and the offset arm is that it becomes easier to control the seat position as set out below. The seat needs to swivel ninety degrees between being perpendicular to the line of travel and being aligned with the line of travel. By having the offset arm offset by thirty degrees on either side, an arc angle of an additional sixty degrees is provided within which to make notches to catch a latch or like in notched plate 132.

In either left hand or right hand-mounting the seat is mounted on the pivot post to face away from an adjacent wall, toward a middle of the stair tread. The two mounting points on the seat ensure that one seat can be used for either type of installation. Further the present invention provides that when the seat is mounted on the pivot post 31 it can only be positioned facing either up or sideways and never down.

Figure 7:
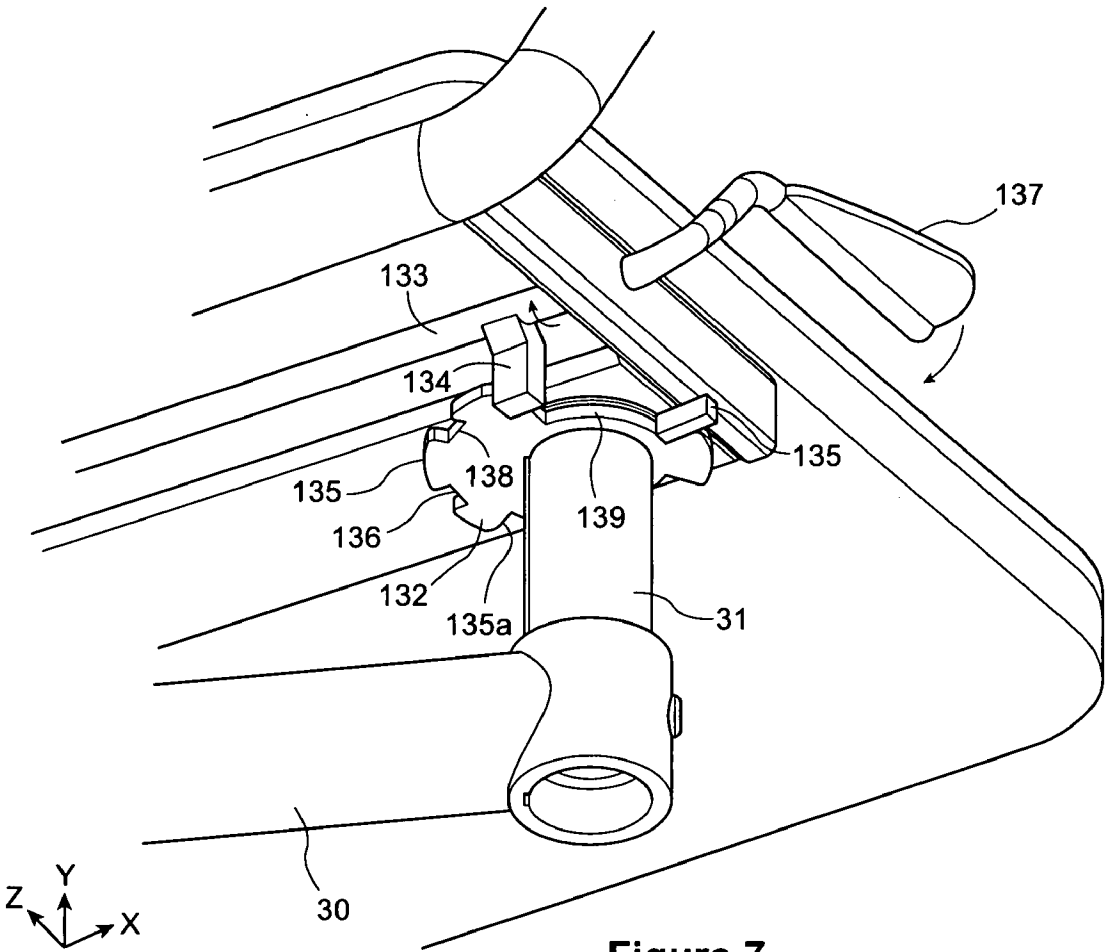
FIG. 7 is a view from below of the underside of the seat showing the seat position selector of the present invention.

FIG. 7 shows notched plate 132 fixed to the pivot post 31. This plate 132 interacts with a seat lock mechanism 133, with a latch 134 located on the underside of the seat portion. These two components together 132, 133 define a means for angularly positioning the seat. When the seat is facing upwardly, the latch 134 sits in a first notch 135 and in combination with a stop 135 prevents the seat from pivoting about the pivot post. This stop 135 is fixed to the seat and moves in slot 139. The slot 139 defines a 90° angle which defines the range of pivoting of the seat. When the seat is facing sideways, the seat lock mechanism sits in a second notch 136 and prevents the seat from rotating. By means of a simple handle actuator 137, the seat lock mechanism can be disengaged from either notch and then the seat can pivot between the two positions. A third notch 139 is provided to fix the seat at a different angle. Second notch 136 is 90° offset from first notch 135. Third notch 138 is offset 90°, in the opposite rotation, from first notch 135*a* on the opposite side of plate 132. In this way plate 132 is equally suited for left and right hand installation. Most preferably the first notch is slightly different from the second and third notches. In the preferred embodiment the second and third notches are shallower notches. A limit switch (not shown) is position on the seat lock mechanism which causes the motor to be deactivated when the seat is aligned with the direction of travel namely when the latch is in the first notch (the mounting and dismounting position). The limit switch further prevents the motor from being activated when the seat is pivoting about the pivot post. Only when the seat is secured in the travel position in the second or third notch (at ninety degrees to the mount/dismount position) does the limit switch permit the motor to be activated.

According to the present invention the notched plate 132 is symmetrical about a central axis of the offset arm. In this way, a single notched plate 132 can be used equally well to accommodate a left hand and a right-hand mounting of the stair lift device 10. No tools are even required as the present invention can be simply and reliably configured into either a left hand or right-hand installation by simply lifting the seating elements out of engagement and then reinserting them into the opposite handed configuration. For safety reason it is preferred to render said motor inoperable unless said seat is in the sideways facing position on the pivot post. Thus, the seat lock mechanism Is preferably instrumented with limit switches to cause this to occur as described above.

The offset arm may be any suitable length, but a preferred length is one that places the center of the seat over the central support post in the side facing or moving position. This is an important aspect of the present invention in that this position permits the foot rest to be used, without modification in either left hand or right-hand position. All that is required is to lift up the foot rest, turn it one hundred and eighty degrees and to replace it on the center post. The seat in either left hand or right-hand positions will be centered over the foot rest and the foot rest in either position is held at the same height relative to the stairs and so is non-interfering in both positions.

Figure 8:
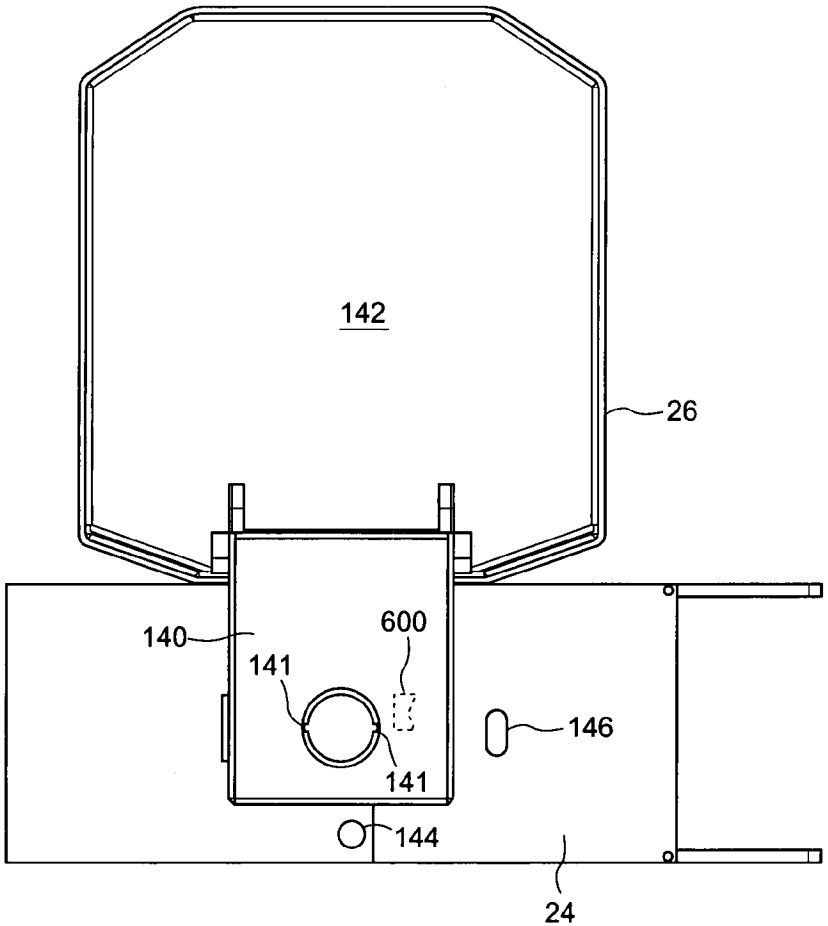
FIG. 8 is a vertical (or overhead) view of a foot rest attached to the motor carriage of the present invention.

FIG. 8 shows a top view of the foot rest 26 mounted on top of the central support 28 on the carriage 24. The foot rest 26 consists of a top portion 140 which is keyed at 141 to non-rotationally mount on the central support 28. A pivoting lower platform 142 or foot rest portion is also provided. As discussed above the foot rest may be positioned in one of two orientations only depending upon which side the mounting is to be made on. Female plug connectors 144, 146 are shown on top of carriage 24 and are explained in more detail below.

Figure 9:
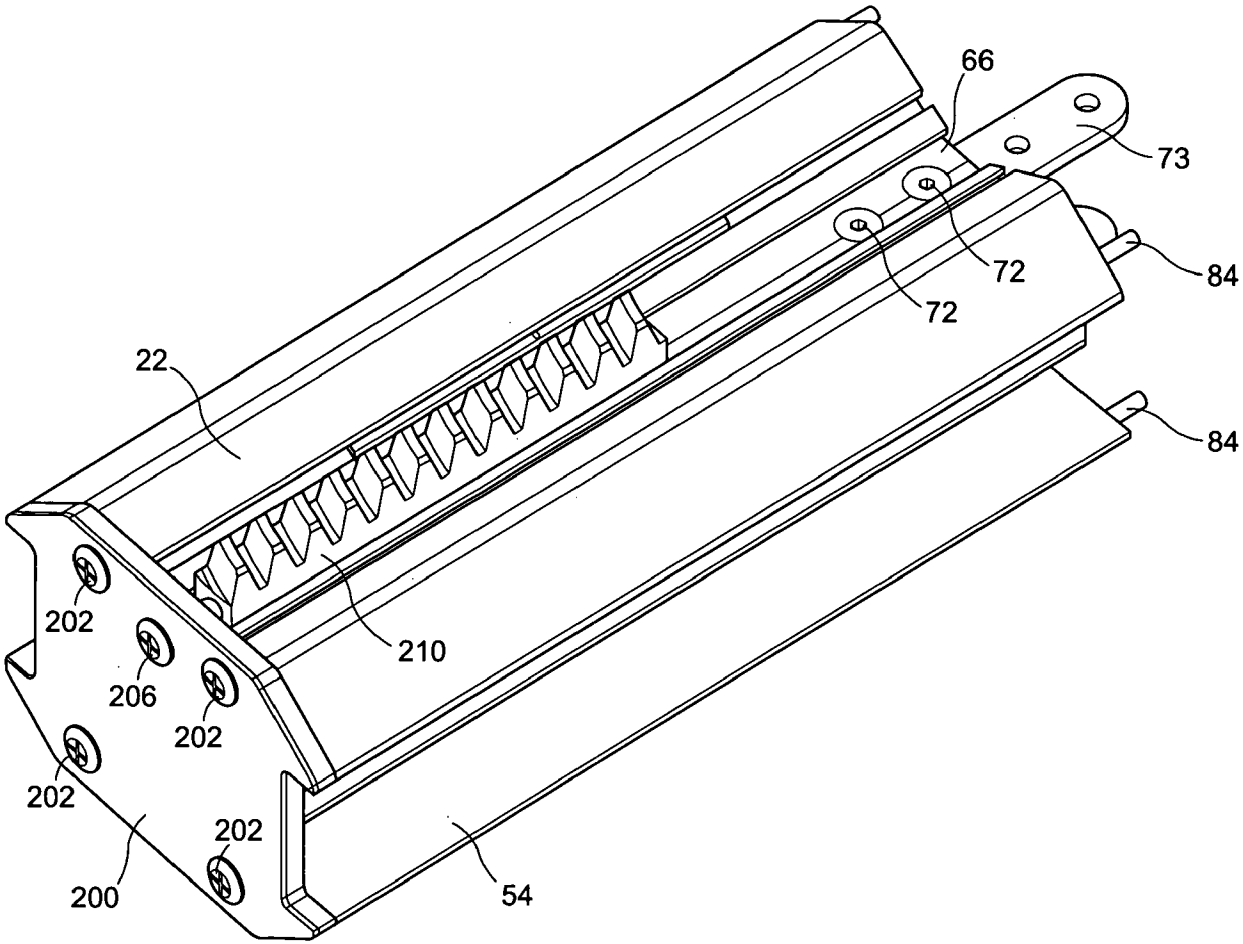
FIG. 9 is a view of the end of travel switches of the present invention.

FIG. 9 shows a section of rail which has been trimmed to length and had an end cap 200 fastened thereto. A number of screws 202 are used to attach the end cap to the rail, and in the preferred embodiment four are used for this purpose. The figure shows a fifth screw 206 which is for compressing the track sections of the present invention. As can seen in the drawing a track section has been installed in the slot 66. The track sections are formed with a larger gap between the teeth at the ends of each abutting track section than the gap between the teeth located inwardly of the ends, and said clamping element applies enough compression to said track sections to compress said larger end gap to the same dimension as the gap between the other teeth. Although not shown, other track sections 210 would also be installed to form a continuous line of fixed teeth of the track along the length of the rail 22. The fifth screw is for pre-loading the track to improve its performance under load. Also shown in FIG. 9 is a plate shaped rail connector 73 attached with screws 72, and shear pins 84, the said rail connectors and shear pins being the means by which two rails are joined.

Figure 10:
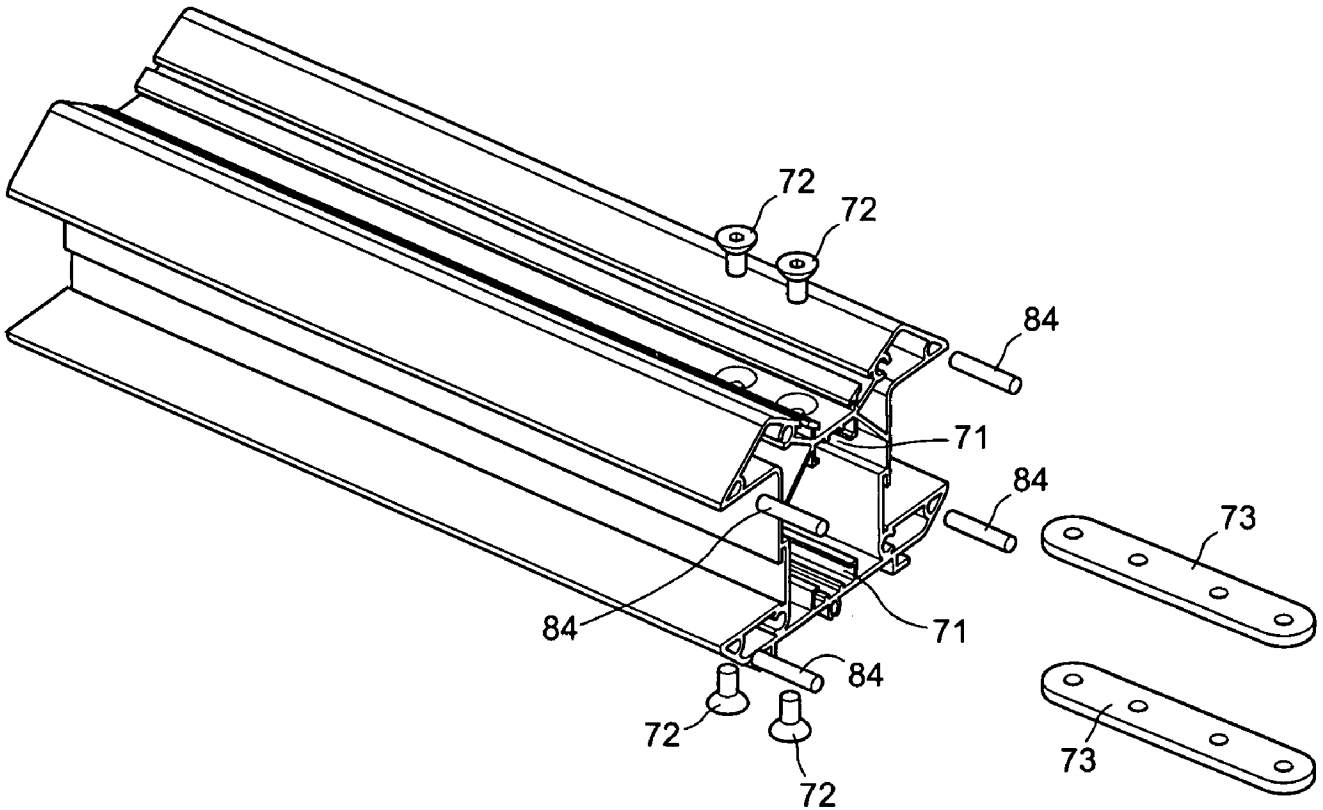
FIG. 10 is a view of a rail support of the present invention.

FIG. 10 shows, in exploded view, one side of an end to end connection of two rail sections. Thus, two connector plates 73 are shown, one at the top and the other at the bottom, each fitting into a slot 71 along with four alignment shear pins 84. As shown preferable two screw fasteners 72 are used on each end of each plate 73. Further the screw fasteners 72 fit into holes which are dimensioned to cause the ends of adjacent rail sections to draw slightly together.

Figure 11:
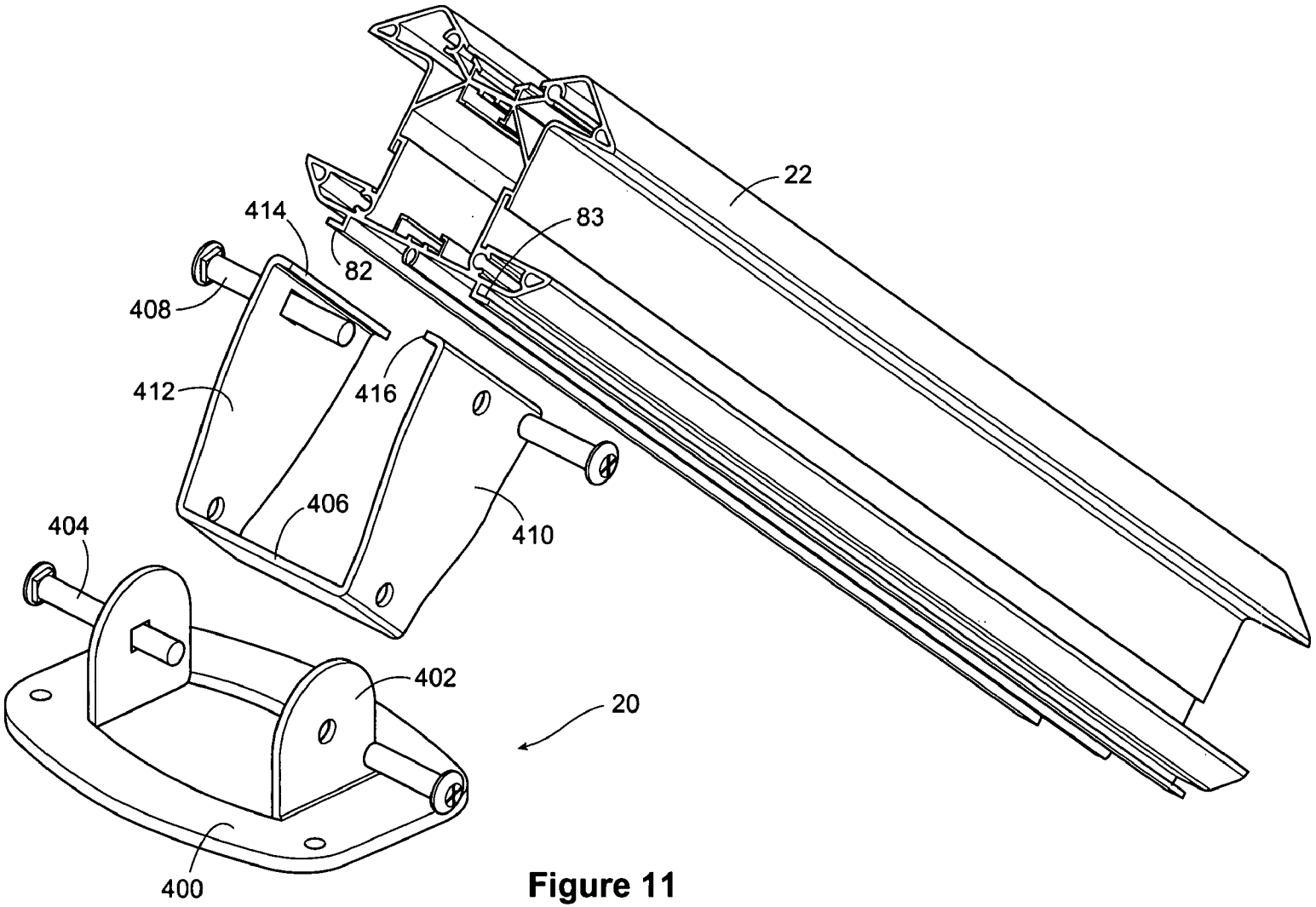
FIG. 11 is a view of the connection device to join two lengths of rail together.

FIG. 11 shows in exploded view the mounting bracket 20 of the present invention and how it fits into the rail 22. The mounting bracket 20 includes a base 400, with upstanding ears 402. A first clamp fastener 404 extends between the ears 402. A bracket 406 fits between the ears 402 and is secured by the first clamp fastener 404. A second clamp fastener 408 extends between free ends 410, 412 of the bracket 406. The free ends 410, 412 are provided with inward projecting lips 414, 416 which fit into mounting arms 82, 83 of the rail 22. The clamp fasteners 404, 408 can be used to clamp the elements together, somewhat loosely at first, for initial positioning of the elements and then can be tightened down when the positioning has been verified. This initial loose but position retaining positioning eliminates a frustration of prior art devices that are too loose, become dislodged at inopportune times during the installation of the rail and thus require more than one installer (i.e., one to hold the elements in place while the other tightens them down). The present invention permits the elements to be adjustable tightened to permit some load bearing during installation to allow the rail to be positioned over the brackets on the stair treads before the brackets are tightened down.

Figure 12:
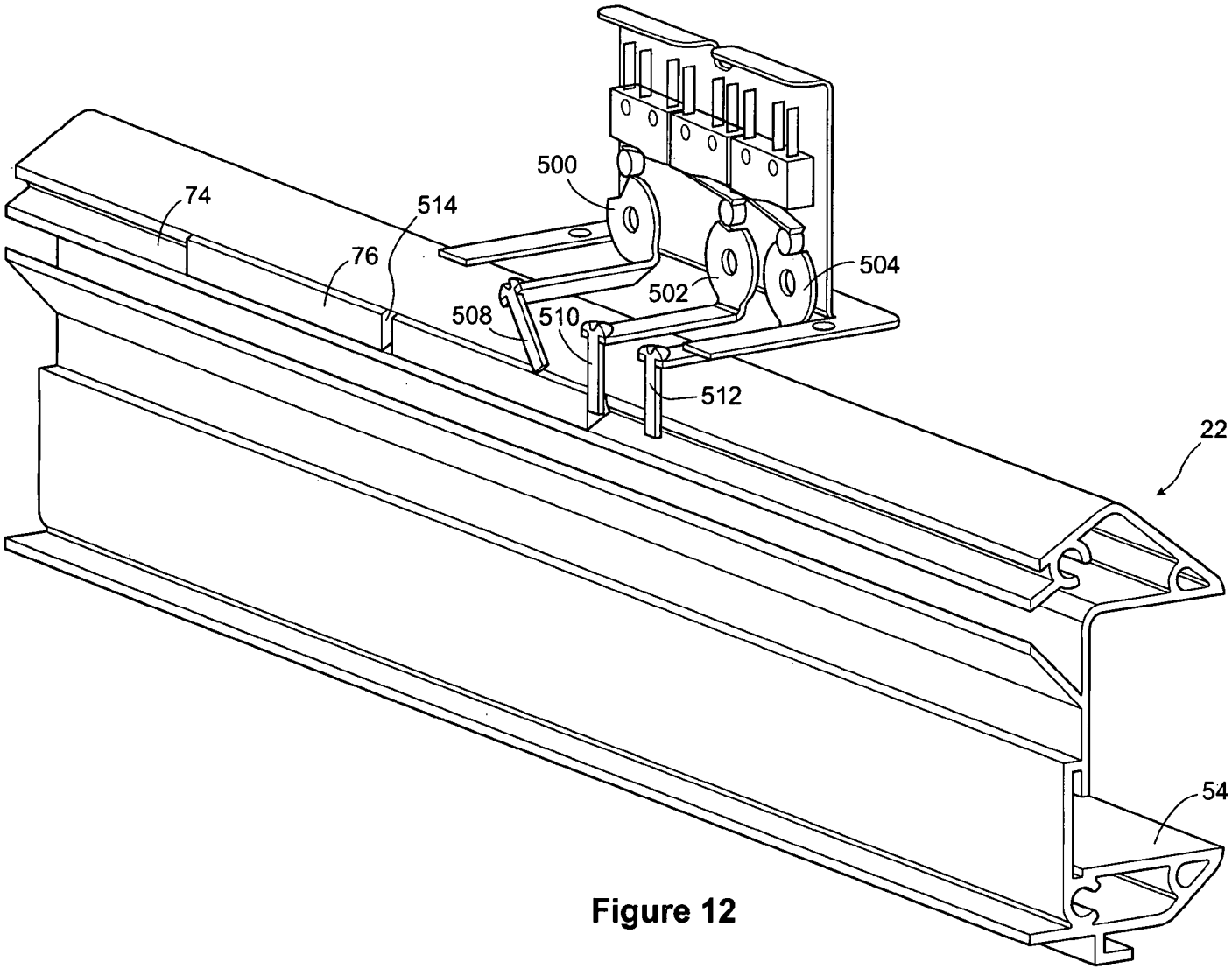
FIG. 12 is a view of an internal trigger mechanism to initiate slowing down and stopping the carriage.

FIG. 12 shows the end stop control of the present invention. The elements are shown in isolation for convenience, although those skilled in the art will realize that these components remounted to the carriage to permit them to achieve the position in space shown in the figure. As shown there are three contact switches 500, 502 and 504. Each contact switch includes a contact arm 508, 510, and 512. When an object contacts a contact arm the contact switch is tripped, signalling a change to the motor. Also, shown in the figure is the trip element 76 retained in groove 74. The trip element 76 is located in place by means of a set screw 514 or the like. In one embodiment of the present invention the first contact causes the motor to slow down when the carriage is moving one way, the second causes it to stop in either direction, and the third to slow down when the carriage is moving the other way. In this way the carriage's travel is brought to a smooth stop at either end of the rail. The present invention provides trip elements of a predetermined size so that when installed in the slot, and placed at an end thereof, the carriage 24 is perfectly adjusted to travel to a smooth stop as described. However, it is also a simple matter to adjust the stopping point at either end to suit individual preference by simply moving the trip element 76 along the slot and fastening it there with the set screw 514.

The simple installation of the present invention can now be described. Most preferably the present invention will be supplied in a kit form in two or three boxes. Two or more boxes are preferred to reduce the weight of each box to 50 pounds or less. The motor and carriage can be located in one box, and the rail, seat and offset arm in the other. Once at the installation location the first step is to set up the rail. The rail sections can be taken out of the box and then joined end to end by means of the plate connectors. Then the rail can be placed on the stairway, and trimmed to length. This can be done with a simple saw, as the extruded aluminum is easy to cut. Then, the track sections are loaded into the upper slots, and the trip elements placed in the correct position. Then the rail is flipped over, and the mounting brackets are placed onto the rail and partially tightened. At this time a power wire can be placed in the raceway and the contacts slid into the appropriate grooves at either end of the rail. The trip elements can also be inserted at both ends of the rail. Then the rail is placed upright and the mounting brackets are positioned and screwed into the stair treads. Then the clamping fasteners are tightened to secure the rail in place. Then the carriage may be taken to the top end of the rail and the wheel bogeys placed into the roller tracks. A disposable plastic or aluminium ramp may be used for guiding the bogeys into the tracks. Once on the track, a manual switch (shown as 600 in FIG. 7) on the top of the carriage may be tripped to cause the motor to advance the carriage along the rail. Most preferably this switch moves the carriage at a reduced speed, such as half speed to facilitate installation. This switch 600 is accessible to move the carriage along the rail 22 during the initial installation process. However, as shown in FIG. 7 when the foot rest is mounted to the carriage the switch 600 is covered and is no longer accessible. This prevents if from being accidentally tripped, or deliberately used as an alternative to the intended main control switch.

It will be appreciated that the rail can be mounted closely adjacent to ether side of the stairway. The same components are used for both a left hand or right hand mounting meaning that same kit components can be used for both types of installations. The next step is to level the center support post. Then the foot rest can be placed overtop, the offset arm dropped into place and the pivot post inserted. Next the seat is placed on the pivot post and then the unit may be tested.

In use the seat is only permitted to swivel between a ride position, in which the seat faces toward the middle of the stair and a dismount position at the top, where the seat faces towards the stair landing. Various other safety features are provided to prevent the motor from continuing to move the carriage when the carriage path is blocked. For example as part of the motor controls there is a programable circuit board. There is provided a master circuit to detect on off switch to detect a current overload. The circuit turns off the motor and shuts down the board when a current overload is detected. The board can only be reset by turning off, then on, the main on/off switch on the carriage. A current overload might occur, for example, when the motor is straining against an obstacle. In the normal operation the current is a maximum of eighteen amps, so a board generated shut down can be caused on a measured current 25 amps. In addition in case this detection fails, a resettable circuit breater integrated with the main on/off switch is tripped at 30 amps.

Also, various portions of the stair lift are instrumented with contact switches, which will also cause the motor to stop if tripped. These are referred to as sensitive surfaces and include, the upstair and downstairs faces of the carriage, the upstairs and downstairs edges of the foot rest, the bottom of the foot rest, and the underside of the foot rest in a folded up position (to prevent harm when the stair lift is operated by remote control). Although one switch could be used, for safety redundancy the present invention comprehends using two such switches for each sensitive surface. As a result of the switches on the sensitive surfaces, there are a number of wires that must be connected to the control board when the seat is fully assembled. To ensure proper wiring, the present invention provides a wiring harness for the foot rest, with a male connector plug at the end. This fits into the female plug connectors 144, 146. However, the wiring harness only reaches one connector 144 or 146, and which one depends on whether it is a right hand or left-hand installation. The female connectors are in turn wired so that upon the plug fitting into the socket the proper wiring connections are made, so that even for an unskilled installer it is not possible to cross wires improperly.

The present invention can be stored out of the way when not in use. A flexible connector, such as a wire, can be installed between the seat portion and the foot rest. In this way both of these elements can be folded up out of the way simultaneously. Because of the offset arm, the seat will be close to the wall. The center mounting of the drive system contributes to a thin carriage and both the foot rest and the seat portion are also made thin. Thus, when the present invention is folded up it leaves the stairway substantially free for ordinary use.

It will be appreciated by those skilled in the art that while reference has been made to certain preferred embodiments of the present invention, various modifications and alterations are possible without departing from the broad spirit of the claims which are attached hereto.

What is claimed is:

1. A stair lift for lifting and lowering at least one person on a stairway, the stair lift comprising:

a rail, the rail having a structural portion and a track, the structural portion of said rail having an upper surface, said rail including a track retaining profile on said upper surface, said track mountable to the upper surface and slidably retained in said track retaining profile, said track comprising a row of plastic molded teeth shaped to engage a spiral drive;

a carriage mountable to said rail, said carriage having a track engaging spiral plastic drive gear, and a motor to power said drive gear, said powered drive causing said carriage to move along said rail;

a seat support mounted on said carriage, said seat support being mountable to said carriage in one of a left side or a right side position;

a seat pivotally mounted on said seat support on a laterally offset pivot axis, and a means for angularly securing said seat in position on said seat support in either said left side or right side position and for selectively releasing said seat to permit said seat to swivel about said laterally offset pivot axis between an upward facing position and a sideways facing position on said seat support to facilitate said person getting into and out of said seat.

2. A stair lift as claimed in claim 1 wherein said structural portion is a hollow section having side channels and said carriage has wheels which ride in said side channels.

3. A stair lift as claimed in claim 1 wherein said teeth are formed into discrete track sections, which abut end to end to form said row of teeth having a substantially even spacing of teeth along said track.

4. A stair lift as claimed in claim 1 wherein said seat support includes a seat support post pivotally mounted at a pivot point to said carriage.

5. A stair lift as claimed in claim 1 wherein said motor drives said spiral plastic drive gear in two directions to permit said carriage to move in opposite directions along said rail.

6. A stair lift as claimed in claim 1 wherein said carriage includes a manual motor switch to activate said motor to facilitate the installation of said carriage on said track.

7. A stair lift as claimed in claim 1 wherein said carriage further includes a foot rest which can be placed on said carriage in one of a left side and right side position.

8. A stair lift as claimed in claim 1 wherein said laterally offset pivot axis is positioned to permit said rail to be mounted closely adjacent to a side of said stairway, without said seat interfering with a side wall thereof.

9. A stair lift as claimed in claim 1 wherein said seat includes at least one offset mount for mounting said seat on said offset arm.

10. A stair lift as claimed in claim 1 wherein said means for angularly securing said seat in position on said seat support comprises a notched plate and a latch sized and shaped to engage said notches mounted between said seat and said seat support, wherein said latch can selectively engage said notches to fix said seat in position.

11. A stair lift as claimed in claim 1 wherein said carriage includes contact switches to disable said motor if said carriage contacts an obstacle.

12. A stair lift as claimed in claim 1 wherein said motor is an battery powered electric motor, wherein said batteries are contained in said carriage, and said carriage includes electrical contacts for connecting to a power supply to recharge said batteries when said carriage is at an end of said rail.

13. A stair lift as claimed in claim 1 wherein said rail is a hollow extruded section which can be trimmed to length.

14. A stair lift as claimed in claim 1 further including a level to aid in orienting said seat support in a vertical orientation about said pivot point.

15. A stair lift as claimed in claim 1 further including a disposable ramp for guiding said carriage onto said rail when installing said carriage on the rail.

16. A stair lift as claimed in claim 2 wherein said carriage further includes bearings adjacent to said wheels.

17. A stair lift as claimed in claim 16 wherein said rail is comprised of two or more sections joined end to end.

18. A stair lift as claimed in claim 17 wherein said rail further includes a race for electrical wires.

19. A stair lift as claimed in claim 18 wherein said rail sections are joined together by connectors, said connectors being sized and shaped to draw abutting edges of said rail sections into tight contact.

20. A stair lift as claimed in claim 19 wherein said rail section includes a channel for retaining a switch trip element.

21. A stair lift as claimed in claim 20 further including a switch trip element housed within said channel to trip switches on said carriage to control movement of said carriage along said rail.

22. A stair lift as claimed in claim 1 wherein said track sections further include a reinforcing element to reduce the displacement of said teeth under loads.

23. A stair lift as claimed in claim 22 wherein said reinforcing element does not extend fully to the ends of each of said track section.

24. A stair lift as claimed in claim 22 wherein said rail includes a clamping element to apply an axial load along said track sections.

25. A stair lift as claimed in claim 24 wherein said clamping element is a pre-loading screw.

26. A stair lift as claimed in claim 4 wherein said seat support post includes a fastener to lock said seat support post at a given angle relative to said carriage.

27. A stair lift as claimed in claim 26 wherein said seat support post is in the form of a single post above said pivotal mounting and is in the form of a forked element below said pivot point, wherein said seat support post can extend down around a motor located within said carriage.

28. A stair lift as claimed in claim 5 wherein said carriage includes limit switches to control operation of said motor.

29. A stair lift as claimed in claim 28 wherein said carriage includes at least three limit switches, one at a time of two to slow said carriage, and the third to stop said carriage as said carriages approaches an end of said rail.

30. A stair lift as claimed in claim 7 wherein said foot rest covers said manual motor switch to prevent access to said switch once the carriage is installed.

31. A stair lift as claimed in claim 9 wherein said seat includes at least two offset mounts for said seat support, with at least one located at either side of said seat wherein said seat may mounted in either a left hand or a right hand offset configuration.

32. A stair lift as claimed in claim 10 wherein said notched plate is fixed to said seat support and said latch is mounted to said seat.

33. A stair lift as claimed in claim 32 wherein said latch is manually accessible from said seat to permit said person to easily lock and unlock said seat.

34. A stair lift as claimed in claim 33 wherein said seat further includes limit switches, where said motor is disabled if said seat is free to swivel and is engaged if said seat is locked in the one correct position facing the center of the stair.

35. A stair lift as claimed in claim 12 wherein said rail includes a mount for mounting a recharging contact to said rail, wherein said recharging contact is positioned to be contacted by said carriage when said carriage is at an end of said rail.

36. A stair lift as claimed in claim 35 wherein said mount is located at either end of said rail to recharge said battery whether said carriage is left at the top or the bottom of the rail.

37. A stair lift as claimed in claim 36 wherein said mount comprises a channel on either side of said rail for inserting a respective positive and negative contact.

38. A stair lift as claimed in claim 37 wherein said channel for said positive contact is different from said channel for said negative contact, wherein only said proper contact may be placed into the mount.

39. A stair lift as claimed in claim 38 wherein said channels are formed along the length of said rail wherein said rail may be trimmed to length without affecting access to said mount.

40. A stair lift as claimed in claim 13 wherein said rail is formed from aluminum.

41. A stair lift as claimed in claim 13 further including one or more feet for securing the rail to a stairway.

42. A stair lift as claimed in claim 14 wherein said level is sized and shaped to fit on top of said seat pest support before said offset arm is attached.

* * * * *